US005088577A

United States Patent [19]

Pierce

[11] Patent Number: 5,088,577

[45] Date of Patent: Feb. 18, 1992

[54] SCAFFOLDING TRANSFER APPARATUS

[76] Inventor: Gerald W. Pierce, 12228 Partridge St. N.W., Coon Rapids, Minn. 55433

[21] Appl. No.: 572,870

[22] Filed: Aug. 27, 1990

[51] Int. Cl.[5] ..... E04G 1/00

[52] U.S. Cl. ..... 182/63; 182/179; 182/230; 414/607

[58] Field of Search ..... 182/63, 178, 145, 127, 182/230; 414/607

[56] References Cited

U.S. PATENT DOCUMENTS

| | | | |
|---|---|---|---|
| 2,598,730 | 6/1952 | Thompson | 182/63 |
| 2,820,561 | 1/1958 | Meagher | 182/63 |
| 2,896,805 | 7/1959 | Rigsby . | |
| 2,966,956 | 1/1961 | Campbell et al. . | |
| 3,016,973 | 1/1962 | Williamson | 182/63 |
| 4,015,685 | 4/1977 | Lenz | 182/145 |
| 4,068,737 | 1/1978 | Lenz | 182/63 |

*Primary Examiner*—Reinaldo P. Machado
*Attorney, Agent, or Firm*—Lawrence M. Nawrocki

[57] ABSTRACT

A device to be employed for moving scaffolding assemblies. The device includes a pair of substantially parallel sleeves intended to receive the tines of a forklift. Support members are affixed to, and project substantially perpendicular from, the sleeves. The support members are telescoping in configuration and include downwardly projecting hooks attached at ends opposite points of attachment of the support members to the sleeves. An interconnecting support member is also provided. Such an interconnecting support member is substantially parallel to the telescoping support members and rigidly attached to the sleeves adjacent the forklift side of the device in order to maintain the sleeves at a defined, desired distance.

7 Claims, 4 Drawing Sheets

SCAFFOLDING TRANSFER APPARATUS

FIELD OF THE INVENTION

This invention relates to assemblies or apparatuses which are employed to move or transfer scaffolds. More specifically, the apparatus of this invention is employed to move at least partially-assembled scaffolding. Yet even more specifically, this invention permits the use of a conventional forklift or fork truck to move or transfer at least a partially-assembled scaffolding.

DESCRIPTION OF THE PRIOR ART

The Meagher patent, U.S. Pat. No. 2,820,561, issued on Jan. 21, 1958 for an invention entitled VEHICULAR HOIST UNIT. The device of that patent includes a workman's staging which is mounted for height adjustments. Adjustment of the staging is effected by the employment of a boom. The boom is, thereafter, used to elevate a load and maintain the load in a vertically adjusted relation to the ground. With a workman or workmen on the staging, the work piece can be secured in position.

U.S. Pat. No. 2,896,805 issued Jul. 28, 1959 (Rigsby) covers a cotton bale resampling and breakout device. The device of the '805 patent is directed primarily toward providing means for handling bales which are stacked in tiers. It is intended to eliminate the necessity for the excess expenditure of time and effort which is required when handling individual bales rather than stacks of bales.

The Campbell et al. patent, U.S. Pat. No. 2,966,965, issued on Jan. 3, 1961. The Campbell device is characterized as an extension tower for use with a forklift truck. The tower of that patent can be raised and lowered and can be transported and operated by a forklift truck. The tower may be used as scaffolding, at the top of which workmen can operate. The tower is especially designed for movement from one location to another by a standard forklift truck. It uses the power of the truck for extending the tower, and is rigid and stable during use.

Lastly, is U.S. Pat. No. 4,015,685 (Lenz). The invention of that reference is characterized as an apparatus for aligning a mobile lift platform. It is directed to a rail mechanism for raising and lowering a work platform which is cantilevered outwardly and laterally on a carriage for movement up and down. Lenz's invention relates, in particular, to the rail structure.

None of the above references, alone or in combination, disclose or suggest the present invention.

BRIEF SUMMARY OF THE INVENTION

Briefly, in an aspect, the present invention is an apparatus for moving at least a partially-assembled scaffolding by means of a forklift, the apparatus having left and right "U"-shaped attachment wings, the open ends of which are attached to the legs of a "C"-shaped central support member and comprising:

substantially parallel sleeves adapted to receive the tines of a forklift, the sleeves further including;

support members, the support members being affixed to and laterally projecting from said sleeves, the support members including;

downwardly projecting hooks mean, the hook means being attached to the distal end of the support members; and an interconnecting member, the interconnecting member being attached to and maintaining the sleeves a distance apart substantially corresponding to the separation of the tines of a forklift.

In a preferred practice, the support members telescope laterally and internally to connect the left and right wings.

DETAILED DESCRIPTION OF THE INVENTION

Scaffolding employed in, e.g., construction or maintenance of buildings, presents certain problems by its size and general unmanageability. Because of those characteristics, it is difficult to move an assembled scaffolding structure from one location to another. This is true even when it is desired to laterally merely position the scaffolding structure only a small distance from its original location Attempts have been made to move sections of the overall scaffolding one-by-one. This method, however, has proved to be time consuming. The present invention is an apparatus for, in a preferred aspect, moving, intact, a totally assembled scaffolding structure or at least a substantial subsection thereof.

Figure 1:
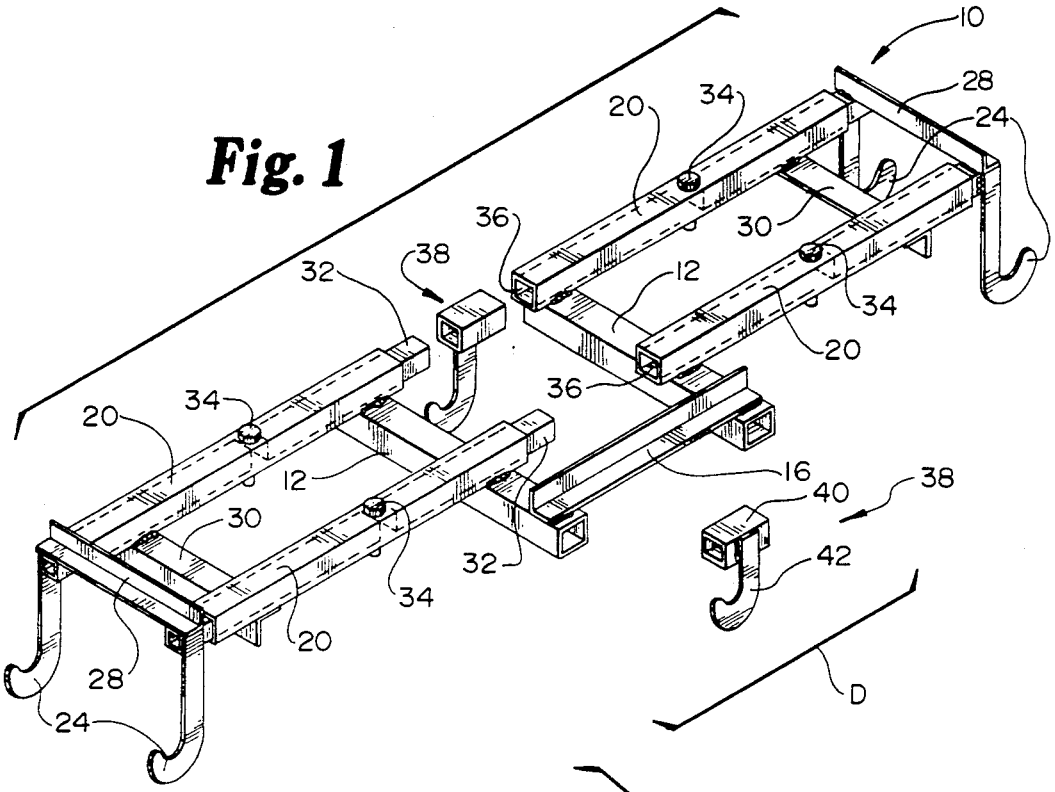
FIG. 1 is a perspective view of an apparatus of the present invention.
Figure 2:
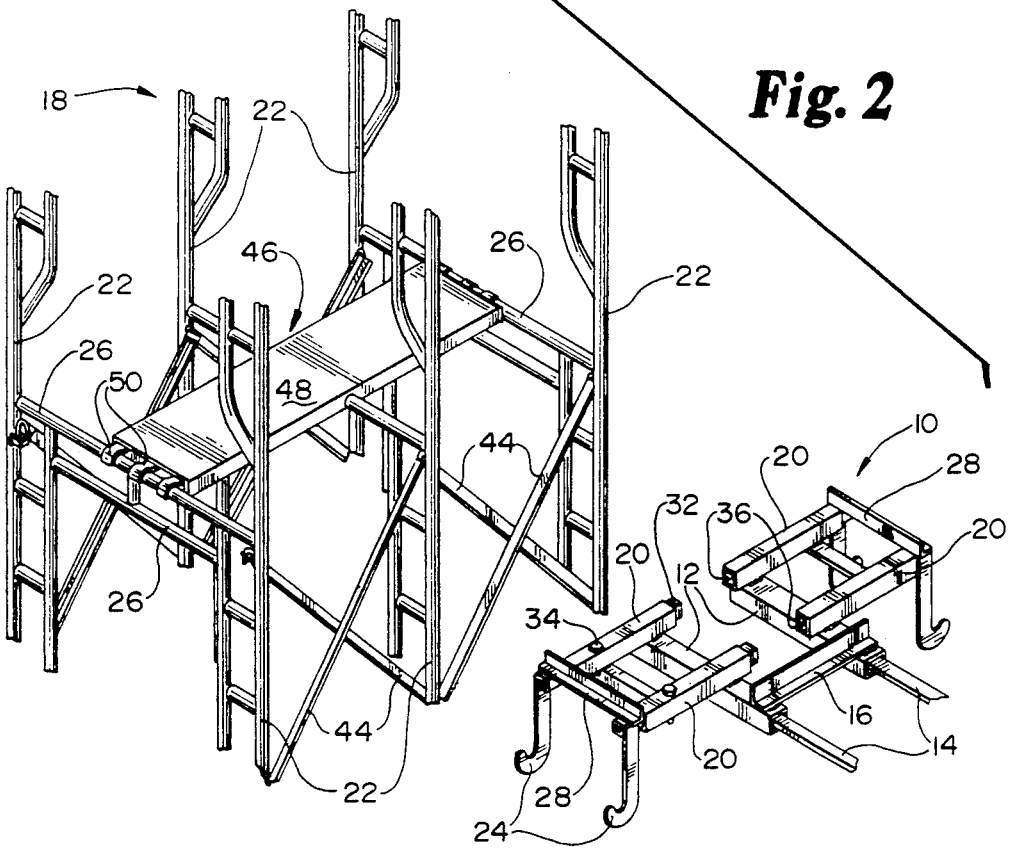
FIG. 2 is an exploded perspective view thereof showing a first position with an assembly of this invention as it would approach an assembled scaffold.

Referring now to the figures, wherein like numerals are used to refer to like features in the various views of the invention, there is shown in FIG. 1 and 2, a perspective view of an apparatus or lifter assembly 10 of this invention in conjunction with a scaffold assembly 18. The apparatus includes a pair of sleeves or sheaths 12 which are receivable over the tines or blades 14 of a forklift (partially shown in FIG. 2). The sleeves are maintained at a fixed distance, corresponding to the separation distance of the tines of the forklift, by an interconnecting member or bridge 16. For example, the sleeves are likely to be separated by a distance in the range of about 40 inches to 48 inches, a range which encompasses a typical distance between lines of a standard forklift. Interconnecting member 16 is positioned at an inner end of the assembly 10 proximate the body of the forklift (not shown) so that assembly 10 can be inserted into a scaffolding structure 18 on the tines 14 of a forklift. The sleeves 12 and interconnecting member 16 define a generally "C"-shaped central support structure.

At least one telescoping arm 20 extends laterally outward from and is connected to sleeve 12. As is shown, the bottom of the arm 20 is connected, e.g., by welding, to the top of sleeve 12. When retracted, the telescoping arm 20 has a length such that it does not extend sufficiently far laterally so that it would engage a vertical member or standard 22 of the scaffolding skeletal assembly 18 as the apparatus 16 on the tines 14 is inserted into the scaffolding architecture 18. Once the apparatus is inserted, however, the telescoping arms 20 can be extended laterally.

The arm or arms 20 are positioned at axial locations along the respective tine engaging sleeves 12 so that stability of a lifted scaffolding assembly is afforded when the present invention is used. In order to further facilitate achievement of this advantage, the ends of the arms 20 can be provided with hook means 24 for receiving and supporting therein horizontal members or rungs 26 of the scaffolding 22.

Also shown in FIGS. 1 and 2 are the particular detailed features of assembly 10 and scaffold 18. Many of the additional features of assembly 10 are intended to impart structural integrity thereto. Hook frame cross-member 28, as well as intermediate cross-members 30, maintain the distance between telescoping arms 20, as well as providing transverse rigidity thereto. Cross-member 28 and arms 20 define a "U"-shaped wing which, as shown, is welded to the top of left and right sleeves 12, respectively.

Arms 20 optionally include interiorly slideable members 32. Slideable members 32 are maintained interiorly in arms 20 by drop pins 34. In one embodiment of this invention, after assembly 10 is placed interiorly in scaffold 18, drop pins 34 would be removed, slideable members 32 would be slid from either the left or right side of the assembly into the corresponding member opening 36 in the opposite arm. Drop pin 34 then would be dropped through slideable member 32 to secure assembly 10 around, for example, a scaffolding vertical member 22. In another practice of this invention, slideable member 32 can be slid through a removable hanger 38 comprising an appropriately sized arm segment 40 having a hook 42 attached thereto. In this practice, removable hanger 38 is employed to add additional vertical stability and lifting capacity to the assembly 10 when used to lift a scaffolding structure 18.

FIG. 2 shows additional detail of a cooperative scaffolding structure 18 which could be used with the present invention. Scaffolding structure 18 includes vertical support members or standards 22, horizontal members or rungs 26, as well as cross-braces 24. Scaffolding structure 18 further includes catwalk means 46 comprising a plank 48 having on the ends thereof claws or hooks 50 which cooperate with horizontal rungs 26. A particular advantage of the present invention is that it permits a scaffold to be moved without removal of the catwalk.

Figure 3:
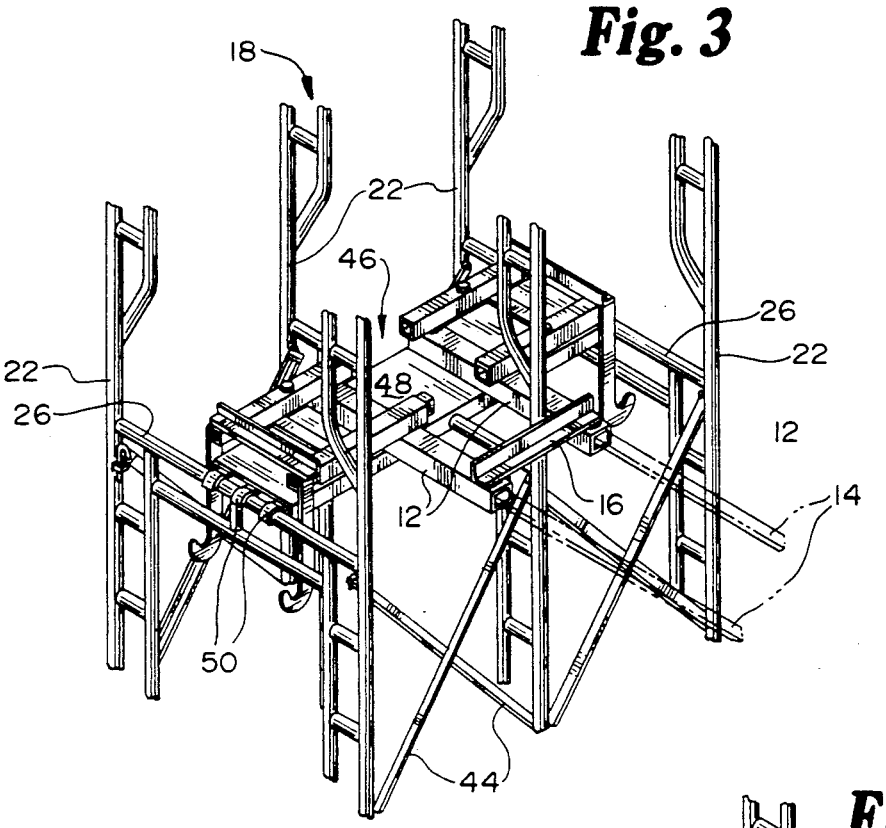
FIG. 3 is a view similar to that of FIG. 2 showing a second position with the invention inserted into the scaffold.

FIG. 3 depicts the assembly supported by forklift tines 14 (for purposes of clarity, the forklift itself is not shown) immediately after assembly 10 has been moved into scaffold structure 18. Assembly 10 is slid into scaffolding structure 18 until interconnecting member 16 is substantially adjacent the central scaffolding vertical member 22. At this point, hook means 24 is positioned below horizontal members or rungs 26.

Figure 4:
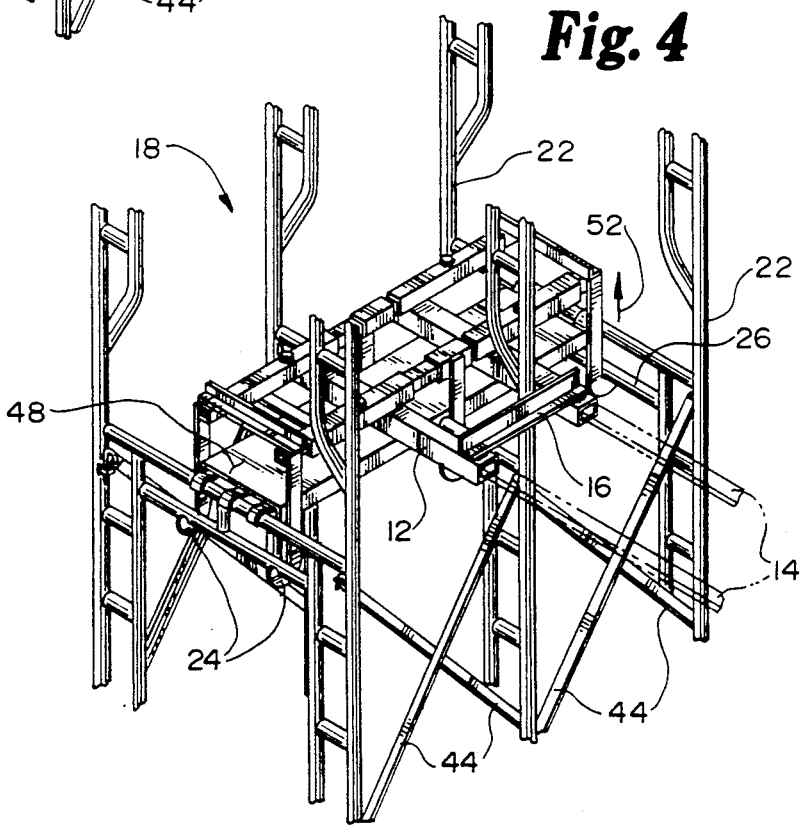
FIG. 4 is a perspective view thereof showing the assembly mated with the scaffold in a position to transport it.

Next the vertical lift mechanism of the forklift is energized and assembly 10 affirmatively engages scaffolding structure 18. This is shown in FIG. 4.

Again, with the body of the forklift not shown for purposes of clarity, hook means 24 engage horizontal members 26 at sufficient number of locations so as to provide stability to the scaffold structure 18 as it is lifted. Arrow 52 indicates the direction which the complete assembly of the apparatus and scaffold will take when the forklift is energized. Also shown in FIG. 4 is that slideable members 32 have been engaged with removable hangers 38 and have been secured into opposite member opening 36 by means of drop pins 34. This maneuver provides additional lateral and transverse stability and support for the assembly as scaffolding structure 18 is lifted.

Figure 5:
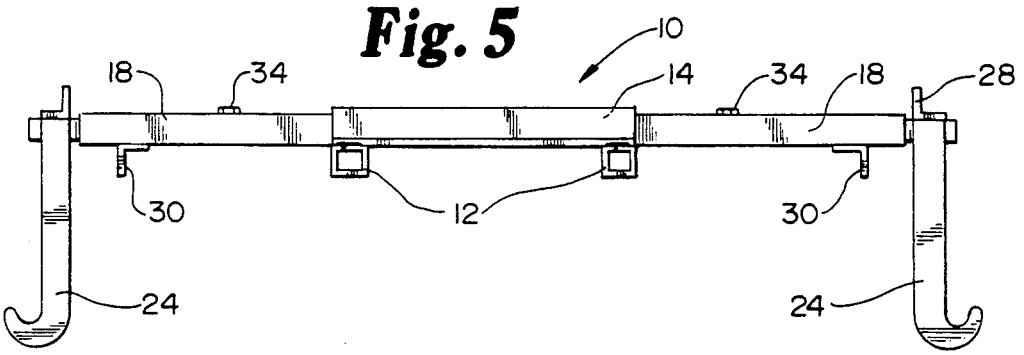
FIG. 5 is a front elevational view thereof.

FIG. 5 illustrates a front elevational view of assembly 10 as it would appear as it is being slid into (or shortly thereafter) the scaffold architecture. Intermediate support member 30 as well as hook frame cross-member 38 are shown to be on opposite sides of telescoping arm 20.

Figure 6:
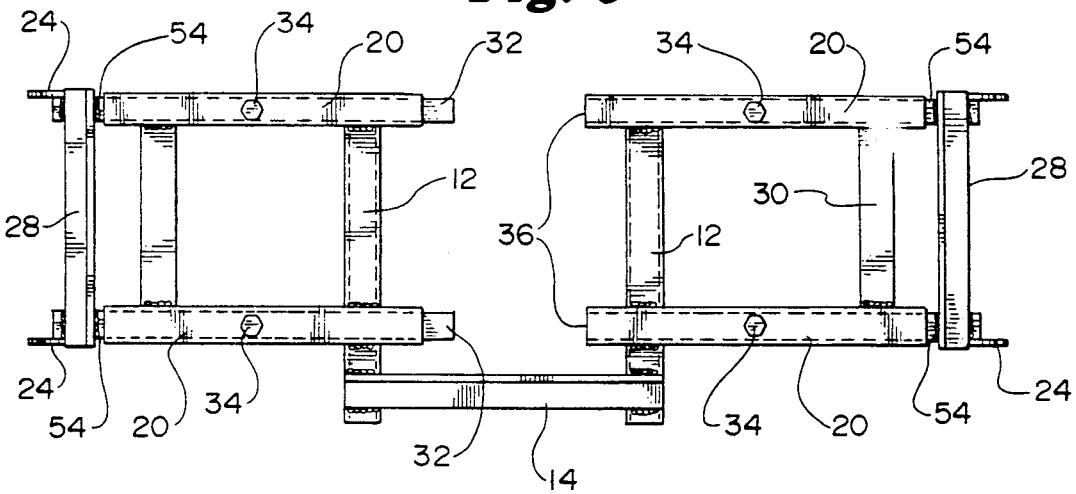
FIG. 6 is a top plan view thereof.

FIG. 6 shows a top plan view of an assembly of the present invention. The assembly is shown to be substantially "C-shaped" before slideable members 32 are slid into member opening 36 subsequent to removal of drop pins 34. Slideable members 32 are shown in phantom inside of telescoping arms 20.

Note that the combination of hook frame cross-member 28 and hook means 24 in conjunction with interior telescoping arm segment 54 form an integral unit which can be laterally moved. This integral unit then could be secured, e.g., by means of drop pins 34 and suitable holes (not shown), to lateral arms 20.

Figure 7:
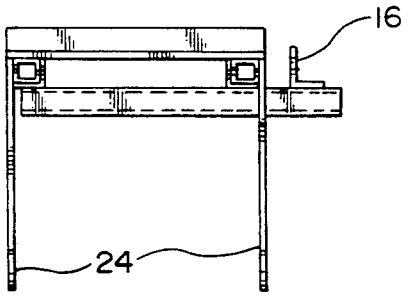
FIG. 7 is an end elevational view thereof.

FIG. 7 shows an elevational view of an assembly of the present invention. As is clearly shown in FIG. 7, interconnecting member or bridge 16 is "L-shaped". Various other shapes and flat segments are within contemplation of the present invention. The "L-shape" provides additional lateral rigidity to the structure.

Figure 8:
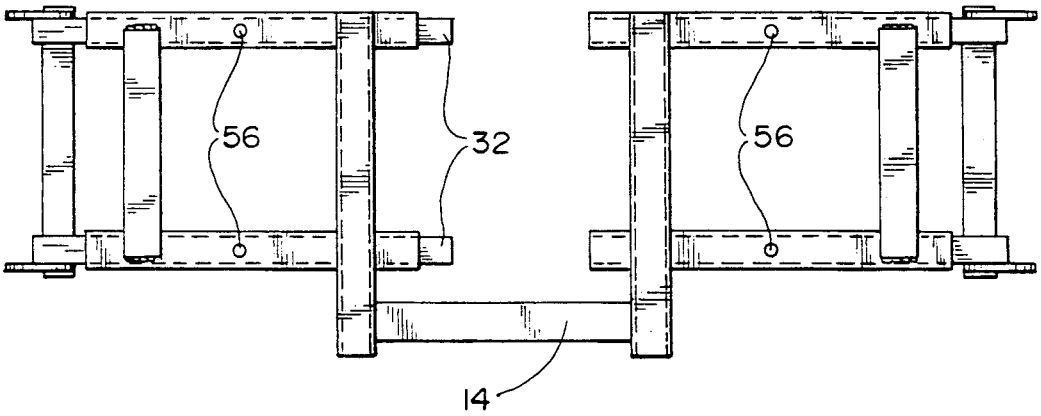
FIG. 8 is a bottom plan view thereof.
Figure 9:
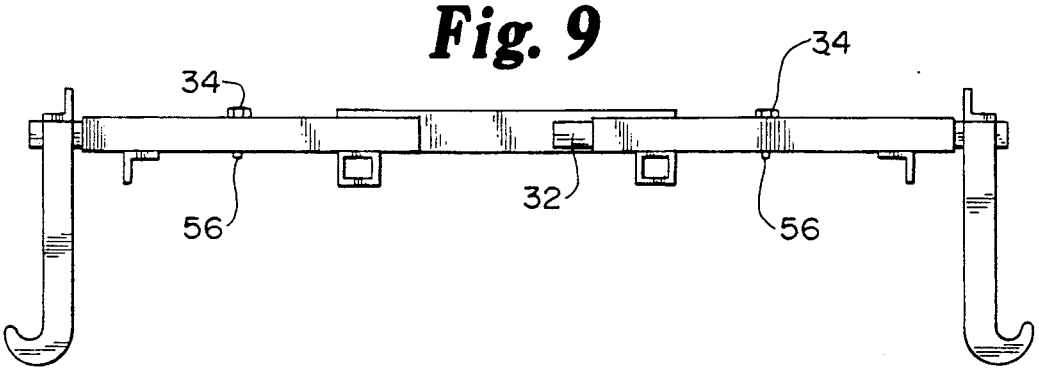
FIG. 9 is a rear elevational view thereof.

FIG. 8 is a bottom plan view of an assembly of the present invention. Of particular note in FIG. 8 are drop pin holes 56. Drop pin holes 56 in conjunction with drop pins 34 fix telescoping arm 20 as well as slideable members 32.

In use, the tines of the lift vehicle, with the sleeves receiving the tines therein, are brought in between the cross-braces and around a center frame of the scaffolding. The telescoping arms are extended outward to either side of the center frame. Hooks at the distal ends of the arms are then positioned so as to receive the horizontal members of the scaffolding therein. Once this positioning is accomplished, the scaffold can then be raised and moved, intact, to another location.

Many variations and combinations of the features of the present invention will become obvious to one of ordinary skill in this art in view of the above disclosure. These variations and combinations are within the scope of the attached claims.

What is claimed is:

1. An apparatus for moving at least partially assembled scaffolding comprising:

(a) substantially parallel sleeves adapted to receive the tines of a forklift, the sleeves further including;

(b) support members, said support members being telescoping and affixed to and projecting substantially perpendicular from said sleeves, the support members including;

(c) downward projecting hook means, the hook means being attached to the end of the support members opposite their point of attachment to said sleeves; and (d) an interconnecting support member, the interconnecting member being substantially parallel to and non-colinear with the support members and rigidly attached to said sleeves adjacent the forklift side of the apparatus so as to maintain the sleeves a distance apart corresponding to the separation of the tines of a forklift.

2. An apparatus according to claim 1 wherein the support members telescope laterally.

3. An apparatus according to claim 1 wherein the support members telescope interiorly and laterally.

4. An apparatus according to claim 1 wherein the support members further include cross-members connected therebetween substantially adjacent their distal ends.

5. An apparatus according to claim 1 which further comprises removable hangers which include a hollow arm segment through which a telescoping portion of the support member can project, and a hook attached thereto.

6. An apparatus according to claim 1 wherein the support members have intermediate support members attached thereto and transversely extending therebetween 7. An apparatus according to claim 6 wherein the intermediate support member extends between said hook means on the end of the support member.

* * * * *